United States Patent [19]

Hutchins

[11] Patent Number: 4,954,939

[45] Date of Patent: Sep. 4, 1990

[54] ADJUSTABLE AND REMOVABLE CHANDELIER CHAIN COVER

[76] Inventor: Brenda Q. Hutchins, P.O. Box 5008, Winston-Salem, N.C. 27113-5008

[21] Appl. No.: 309,186

[22] Filed: Feb. 13, 1989

[51] Int. Cl.[5] ..... F21S 3/06

[52] U.S. Cl. ..... 362/406; 59/93

[58] Field of Search ..... 59/93, 78, 78.1; 280/808; 297/482; 362/405, 406, 404, 407, 391; 150/155, 160, 901

[56] References Cited

U.S. PATENT DOCUMENTS

| | | | |
|---|---|---|---|
| 847,228 | 3/1907 | Bixby, Jr. | 59/78 |
| 1,832,271 | 11/1931 | Williams | 59/78 |
| 2,020,943 | 11/1935 | Hallquist | 59/78 |
| 2,207,043 | 7/1940 | Weiss | 59/78 |
| 2,973,223 | 2/1961 | Whatley | 59/778 |
| 3,002,409 | 10/1961 | Jones | 59/78 |
| 3,957,282 | 5/1976 | Finnigan | 297/482 |
| 4,505,465 | 3/1985 | McCrary | 59/78 |
| 4,699,401 | 10/1987 | Saenz | 297/482 |
| 4,741,574 | 5/1988 | Weightman et al. | 297/482 |
| 4,779,411 | 10/1988 | Kendall | 59/78 |
| 4,786,080 | 11/1988 | Jay | 297/482 |

FOREIGN PATENT DOCUMENTS

| | | | |
|---|---|---|---|
| 2048651 | 12/1980 | United Kingdom | 297/482 |

*Primary Examiner*—David Jones

[57] ABSTRACT

An adjustable and removable chandelier chain cover formed from a portion of flexible fabric material encircling the chandelier chain having first and second engagement edges so that engaging edges so that the engaging edges when pressed together form a connectable and flexible joint for the cover around the chandelier chain. The fastening means may be strips of fabric, some carrying a plurality of hook elements and others carrying a plurality of cooperating loop elements. The length of the cover may be adjusted by gathering the cover if its length exceeds the length of the chain to accommodate and adjust to the length of the shorter chain length and extending the cover to a less gathered or ungathered condition when the chain length is longer.

6 Claims, 1 Drawing Sheet

ADJUSTABLE AND REMOVABLE CHANDELIER CHAIN COVER

BACKGROUND OF THE INVENTION

1. Field of the Invention

This invention pertains to a article covers and particularly to an adjustable and removable chandelier chain cover.

2. Statement of Prior Art

Removable cylindrically shaped protective covers have been used frequently to cover a multitude of needs. See for example U.S Pat. Nos. 3,866,649; 3,654,049; 3,906,129; and 3,038,558. These references include cart handle covers, insulating covers for fluid containers, and protective jackets for conductors and the like. They disclose applications which usually enable a flexible cover to be secured about a protected item by an extruded fastener or zipper. In some applications, however, an extrusion or zipper imparts a stiffness to the fabric that does not enable it to be flexibly adjusted for various lengths.

A flexible securing mechanism may be formed from a strip of fastening material having series of hook-like projections extending therefrom cooporating with a second fastening strip having hirsute, loop-bearing, or felt-like material extending therefrom to provide cooperating fastening edges. An example of material suitable for this purpose is that sold under the trademarks VELSTIKE and VELCRO. Material of this construction is usually referred to as having hook and loop elements. This fastening application has been utilized in various ways. See U.S. Pat. Nos. 3,143,154 and 3,491,800.

SUMMARY OF THE INVENTION

The article comprising the present invention is usable primarily as a cover for chandelier chains, because it is adjustable to accommodate various links of such chains and removable to enable the cover to be cleaned from time to time without the necessity of disconnecting a supported light fixture from the chain. In its preferred form, it includes a longitudinal portion of flexible fabric material positioned in an encircling relationship about the chain of a chandelier. The fabric portion has first and second engaging edges that cooperate when the portion is wrapped about the chain to fasten against each other to form a joint. A strip of fastening material having a series of minute hook-like projections (hook elements) thereon is fixedly secured to one of the engaging edges, and a strip of fastening material having threads extending outwardly therefrom forming enclosed flexible loops (loop elements) or any other hirsuit or felt-like material is secured to the other engaging edge so that the edges meet when the fabric portion encircles the chandelier chain and the hook elements projections engage the loop elements or other material when the edges are pressed together to form a connecting and flexible joint.

Length adjustment of the chain cover, a primary objective, is effected by gathering the material in the same manner as a drapery or curtain panel is pushed back and gathered along a supporting rod. Zippers or extruded fasteners may not work well in some applications of this nature because the stiffness imparted by the zipper or closure member might interfere with the "gathering" of the cover. While snaps and other releasably securable fasteners may function satisfactorily in some applications, there may be occasions when their use might be too expensive and require intensive skilled labor to install.

The fabric material is washable and may be water and vapor proof, corrosive resistant, and flame retardant. The covering may be supplied in various colors if desired to permit matching with other interior colors of the room in which it is used.

Other and further objectives and advantages of the present invention will become more apparent to those skilled in the art after consideration of the following detailed specification taken in conjunction with the accompanying drawings wherein like characters of reference designate like parts throughout the several views.

DESCRIPTION OF THE PREFERRED EMBODIMENT

Figure 1:
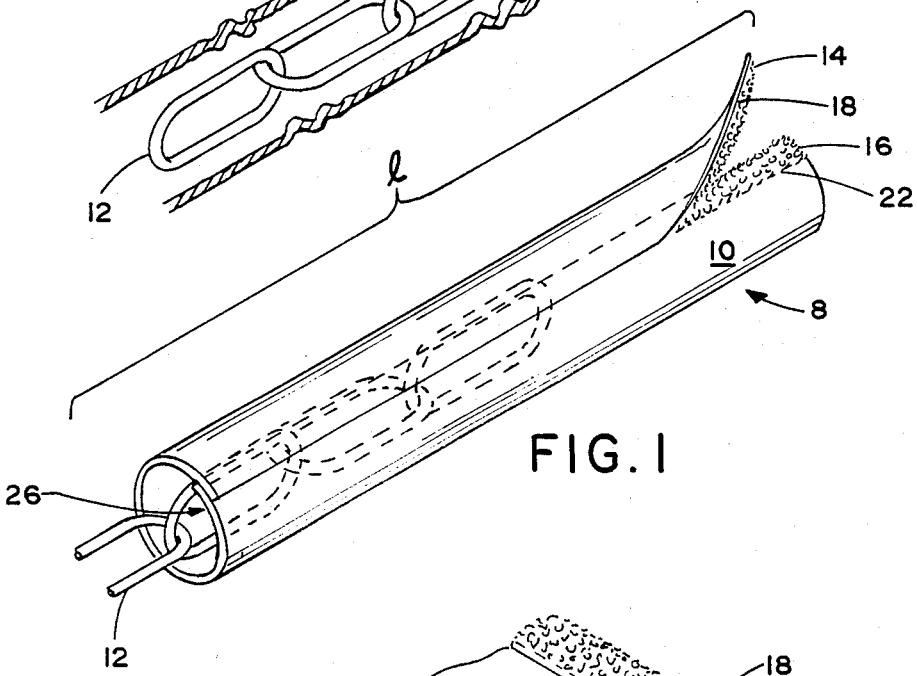
FIG. 1 is a perspective, partial and sectional view of a chandelier chain being encircled by an adjustable and removable chain cover comprising the present invention illustrating the hook and loop elements adhered to the engaging edges of the cover fabric.

Referring to the drawings and more particularly to FIG. 1, a chandelier cover shown generally as 8 includes a portion of fabric material 10 having a discreet longitudinal length 1 wrapped about a chandelier chain 12 in the manner shown. The fabric material portion 10 has first and second engaging edges 14,16. A strip of fastening material 18 having a series of minute hook-like projections 20 (FIG. 3) is secured to one of the engaging edges, and a strip of fastening material 22 having threads extending outwardly therefrom forming enclosed flexible loops 24 (FIG. 3) is secured to the other edge. These projections and threads are generally referenced as hook and loop elements. The strips of fastening material 18,22 engage each other when fabric portion 10 encircles the chandelier chain 12 and the hook-like projections 20 engage the closed flexible loops 24 to form a continuous and flexible joint shown generally as 26.

Since the cover 8 is selectively removable from around chain 12, it can be cleaned from time to time and reinstalled without disconnecting the chandelier from its supporting chain and cooperating electrical conductors.

Figure 2:
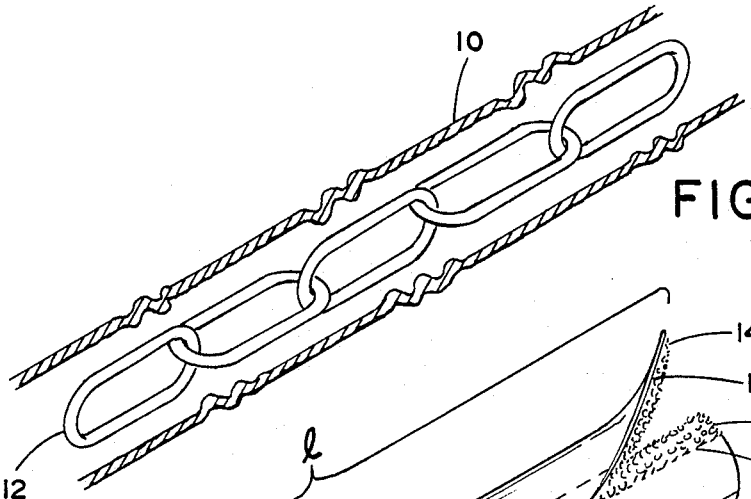
FIG. 2 is a perspective and phantom view of a cover comprising the present invention lightly gathered about a covered chain.
Figure 4:
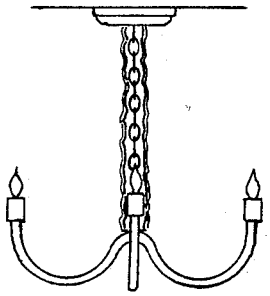
FIG. 4 is a side elevational and sectional view of a chandelier extending from a supporting ceiling whose chain is encircled by the cover comprising the present invention which is in a slightly gathered condition.

FIG. 2 shows fabric material portion 10 forming cover 8 in a gathered relationship about chain 12. This condition is necessary from time to time in order to utilize a cover whose length exceeds the length of the chain to be covered. See for example the installation drawing of FIG. 4.

The strip of fastening material 18 is secured to and preferable extends along the entire length of the exterior edge 14 of fabric material portion 10. The fastening material includes a series of hook elements extending therefrom. I is preferably adhesively bonded in place. Obviously, other means may be utilized to secure the strip to fabric portion 10. A typical example of material suitable for this purpose is that sold under the trademarks VELSTICK and VELCRO.

Figure 3:
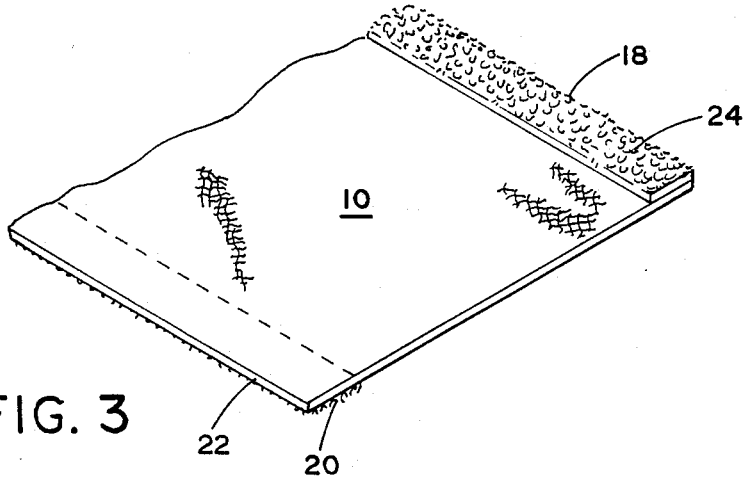
FIG. 3 is another perspective view of a section of the fabric material comprising the present invention to which is secured strips of fastening material having hoop and loop elements secured thereto as herein described.

The other edge 16 of fabric material portion 10 supports a strip 18 of fastening material having threads extending outwardly therefrom forming flexible loops 24 (loop elements). The Strip 18 as shown in FIG. 3 extends on the outer edge 16 of fabric material portion 10 along the full extent of that edge.

From the foregoing it can be seen that a full complement of fabrics and colors may be utilized in the present inventive concept. Moreover, the fabric may be waterproof, corrosive resistant, and flame retardant as the application requires.

The invention may be embodied in other specific forms without departing from the spirit or essential characteristics thereof. The present embodiments are therefore considered in all respects as illustrative and not restrictive, the scope of the invention being indicated by the impending claims rather than by the foregoing descriptions. All changes which come within the meaning and range of the equivalency of the claims are therefore intended to be embraced therein.

What is claimed and desired to be secured by Letters Patent is:

1. In a chandelier fixture affixed to a supporting ceiling having a chandelier, a chain with first and second ends, the first end secured to said chandelier and the second end secured to the ceiling, a light carried by said chandelier, and electrical conductors cooperatively extending along said chain, the improvement comprising: an adjustable and removeable chandelier chain cover encircling said chandelier chain and said cooperating electrical conductors and extending from the ceiling to said chandelier, a longitudinal portion of fabric material encircling the chandelier chain having a predetermined length sufficient to cover entirely the chain and conductors cooperating therewith and first and second engaging edges, fastening means fixedly secured to one of said portion-engaging edges, and a strip of fastening material secured to the other of said portion-engaging edges whereby the strips of fastening material engage each other when the edges are joined and the portion of fabric material encircles the chandelier chain and conductors to form a tubular cover having a circular cross-section and a connecting and flexible joint.

2. The cover as claimed in claim 1 wherein the material portion is selectively cleanable upon removal from about the chandelier chain.

3. The cover as claimed in claim 2 wherein the fabric portion is color changeable.

4. The cover as claimed in claim 1 wherein the fabric portion is shortenable and lengthable to adjust the predetermined portion length to accommodate varying lengths of chandelier chains.

5. The cover as claimed in claim 1 wherein said portion of fabric material is nylon.

6. The cover as claimed in claim 1 wherein said fastening means includes a first strip of fastening material having a series of minute hook-like projections thereon fixedly secured to one of said portion engaging edges, and a secured strip of fastening material having threads extending outwardly therefrom forming enclosed flexible loops secured to the other of said portion engaging edges.

* * * * *